US010451290B2

(12) United States Patent
Mayberry

(10) Patent No.: US 10,451,290 B2
(45) Date of Patent: Oct. 22, 2019

(54) FORCED CONVECTION STEAM ASSEMBLY

(71) Applicant: WHIRLPOOL CORPORATION, Benton Harbor, MI (US)

(72) Inventor: Timothy A. Mayberry, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 248 days.

(21) Appl. No.: 15/451,760

(22) Filed: Mar. 7, 2017

(65) Prior Publication Data

US 2018/0259192 A1 Sep. 13, 2018

(51) Int. Cl.
*F24C 15/00* (2006.01)
*F24C 15/32* (2006.01)

(52) U.S. Cl.
CPC ..... *F24C 15/003* (2013.01); *F24C 15/327* (2013.01)

(58) Field of Classification Search
CPC ..... F24C 15/003; F24C 15/327
USPC ..... 219/401
See application file for complete search history.

(56) References Cited

U.S. PATENT DOCUMENTS

| | | | |
|---|---|---|---|
| 1,141,176 | A | 6/1915 | Copeman |
| 1,380,656 | A | 6/1921 | Lauth |
| 1,405,624 | A | 2/1922 | Patterson |
| 1,598,996 | A | 9/1926 | Wheelock |
| 1,808,550 | A | 6/1931 | Harpman |
| 2,024,510 | A | 12/1935 | Crisenberry |
| 2,530,991 | A | 11/1950 | Reeves |
| 2,536,613 | A | 1/1951 | Schulze et al. |
| 2,777,407 | A | 1/1957 | Schindler |
| 2,781,038 | A | 2/1957 | Sherman |
| 2,815,018 | A | 12/1957 | Collins |
| 2,828,608 | A | 4/1958 | Cowlin et al. |
| 2,847,932 | A | 8/1958 | More |
| 2,930,194 | A | 5/1960 | Perkins |
| 2,934,957 | A | 5/1960 | Reinhart et al. |
| D191,085 | S | 8/1961 | Kindl et al. |
| 3,017,924 | A | 1/1962 | Jenson |

(Continued)

FOREIGN PATENT DOCUMENTS

| | | | |
|---|---|---|---|
| CA | 2365023 | A1 | 7/2002 |
| CA | 2734926 | A1 | 10/2011 |

(Continued)

OTHER PUBLICATIONS

Built-In Gas Cooktop, image post date Feb. 18, 2015, originally in U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.

(Continued)

*Primary Examiner* — Avinash A Savani
*Assistant Examiner* — Aaron H Heyamoto
(74) *Attorney, Agent, or Firm* — Price Heneveld LLP

(57) ABSTRACT

A convection oven includes a convection fan assembly and a trough assembly that surrounds a portion of the heating element(s) of the convection fan assembly. Fluid in the trough assembly is heated and turned into steam by the heating element(s) and blown into the cooking cavity of the convection oven by the convection fan of the convection fan assembly. The steam in the cooking cavity provides moisture to the items that are being cooked and/or heated in the cooking cavity.

8 Claims, 6 Drawing Sheets

(56) References Cited

U.S. PATENT DOCUMENTS 3,051,813 A 8/1962 Busch et al.
3,089,407 A 5/1963 Kinkle
3,259,120 A 7/1966 Keating
3,386,431 A 6/1968 Branson
3,463,138 A 8/1969 Lotter et al.
3,489,135 A 1/1970 Astrella
3,548,154 A 12/1970 Christiansson
3,602,131 A 8/1971 Dadson
3,691,937 A 9/1972 Meek et al.
3,731,035 A 5/1973 Jarvis et al.
3,777,985 A 12/1973 Hughes et al.
3,780,954 A 12/1973 Genbauffs
3,857,254 A 12/1974 Lobel
3,877,865 A 4/1975 Duperow
3,899,655 A 8/1975 Skinner
D245,663 S 9/1977 Gordon
4,149,518 A 4/1979 Schmidt et al.
4,363,956 A 12/1982 Scheidler et al.
4,413,610 A 11/1983 Berlik
4,418,456 A 12/1983 Riehl
4,447,711 A 5/1984 Fischer
4,466,789 A 8/1984 Riehl
4,518,346 A 5/1985 Pistien
4,587,946 A 5/1986 Doyon et al.
4,646,963 A 3/1987 Delotto et al.
4,654,508 A 3/1987 Logel et al.
4,689,961 A 9/1987 Stratton
4,812,624 A 3/1989 Kern
4,846,671 A 7/1989 Kwiatek
4,886,043 A 12/1989 Homer
4,891,936 A 1/1990 Shekleton et al.
D309,398 S 7/1990 Lund
4,981,416 A 1/1991 Nevin et al.
4,989,404 A 2/1991 Shekleton
5,136,277 A 8/1992 Civanelli et al.
5,171,951 A 12/1992 Chartrain et al.
D332,385 S 1/1993 Adams
5,190,026 A 3/1993 Doty
D340,383 S 10/1993 Addison et al.
5,272,317 A 12/1993 Ryu
D342,865 S 1/1994 Addison et al.
5,397,234 A 3/1995 Kwiatek
D364,993 S 12/1995 Andrea
5,491,423 A 2/1996 Turetta
D369,517 S 5/1996 Ferlin
5,546,927 A 8/1996 Lancelot
D378,578 S 3/1997 Eberhardt
5,618,458 A 4/1997 Thomas
5,649,822 A 7/1997 Gertler et al.
5,735,261 A 4/1998 Kieslinger
5,785,047 A 7/1998 Bird et al.
5,842,849 A 12/1998 Huang
5,913,675 A 6/1999 Vago et al.
5,928,540 A 7/1999 Antoine et al.
D414,377 S 9/1999 Huang
5,967,021 A 10/1999 Yung
6,030,207 A 2/2000 Saleri
6,050,176 A 4/2000 Schultheis et al.
6,089,219 A 7/2000 Kodera et al.
6,092,518 A 7/2000 Dane
6,111,229 A 8/2000 Schultheis
6,114,665 A 9/2000 Garcia et al.
6,155,820 A 12/2000 Döbbeling
6,188,045 B1 2/2001 Hansen et al.
6,192,669 B1 2/2001 Keller et al.
6,196,113 B1 3/2001 Yung
6,253,759 B1 7/2001 Giebel et al.
6,320,169 B1 11/2001 Clothier
6,322,354 B1 11/2001 Carbone et al.
6,362,458 B1 3/2002 Sargunam et al.
6,452,136 B1 9/2002 Berkcan et al.
6,452,141 B1 9/2002 Shon
6,589,046 B2 7/2003 Harneit
6,614,006 B2 9/2003 Pastore et al.
6,619,280 B1 9/2003 Zhou et al.
6,655,954 B2 12/2003 Dane
6,663,009 B1 12/2003 Bedetti et al.
6,718,965 B2 4/2004 Rummel et al.
6,837,151 B2 1/2005 Chen
6,891,133 B2 5/2005 Shozo et al.
6,930,287 B2 8/2005 Gerola et al.
7,005,614 B2 2/2006 Lee
7,017,572 B2 3/2006 Cadima
D524,105 S 7/2006 Poltronieri
7,083,123 B2 8/2006 Molla
7,220,945 B1 5/2007 Wang
D544,753 S 6/2007 Tseng
7,274,008 B2 9/2007 Arnal Valero et al.
7,281,715 B2 10/2007 Boswell
7,291,009 B2 11/2007 Kamal et al.
7,325,480 B2 2/2008 Gruhbaum et al.
D564,296 S 3/2008 Koch et al.
7,348,520 B2 * 3/2008 Wang ..... F24C 15/327 126/20
7,368,685 B2 5/2008 Nam et al.
7,411,160 B2 8/2008 Duncan et al.
7,417,204 B2 8/2008 Nam et al.
D581,736 S 12/2008 Besseas
7,468,496 B2 12/2008 Marchand
D592,445 S 5/2009 Sorenson et al.
D598,959 S 8/2009 Kiddoo
7,589,299 B2 9/2009 Fisher et al.
D604,098 S 11/2009 Hamlin
7,614,877 B2 11/2009 McCrorey et al.
7,628,609 B2 12/2009 Pryor et al.
7,640,930 B2 1/2010 Little et al.
7,696,454 B2 4/2010 Nam et al.
7,708,008 B2 5/2010 Elkasevic et al.
7,721,727 B2 5/2010 Kobayashi
7,731,493 B2 6/2010 Starnini et al.
7,762,250 B2 7/2010 Elkasevic et al.
7,770,985 B2 8/2010 Davis et al.
7,781,702 B2 8/2010 Nam et al.
7,823,502 B2 11/2010 Hecker et al.
7,829,825 B2 11/2010 Kühne
7,841,333 B2 11/2010 Kobayashi
7,964,823 B2 6/2011 Armstrong et al.
D642,675 S 8/2011 Scribano et al.
8,006,687 B2 8/2011 Watkins et al.
8,015,821 B2 9/2011 Spytek
8,037,689 B2 10/2011 Oskin et al.
8,141,549 B2 3/2012 Armstrong et al.
8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,393,317 B2 3/2013 Sorenson et al.
8,398,303 B2 3/2013 Kuhn
8,464,703 B2 6/2013 Ryu et al.
D685,225 S 7/2013 Santoyo et al.
D687,675 S 8/2013 Filho et al.
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,707,945 B2 4/2014 Hasslberger et al.
8,747,108 B2 6/2014 Lona Santoyo et al.
8,800,543 B2 8/2014 Simms et al.
D718,061 S 11/2014 Wu
8,887,710 B2 11/2014 Rossi et al.
8,930,160 B2 1/2015 Wall et al.
8,932,049 B2 1/2015 Ryu et al.
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.

(56) References Cited

U.S. PATENT DOCUMENTS

| | | | |
|---|---|---|---|
| 9,074,765 | B2 | 7/2015 | Armanni |
| D735,525 | S | 8/2015 | Nguyen |
| 9,113,503 | B2 | 8/2015 | Arnal Valero et al. |
| 9,132,302 | B2 | 9/2015 | Luongo et al. |
| D743,203 | S | 11/2015 | Filho et al. |
| 9,175,858 | B2 | 11/2015 | Tisselli et al. |
| D750,314 | S | 2/2016 | Hobson et al. |
| 9,307,888 | B2 | 4/2016 | Baldwin et al. |
| D758,107 | S | 6/2016 | Hamilton |
| D766,036 | S | 9/2016 | Koch et al. |
| D766,696 | S | 9/2016 | Kemker |
| 9,513,015 | B2 | 12/2016 | Estrella et al. |
| 9,521,708 | B2 | 12/2016 | Adelmann et al. |
| 9,572,475 | B2 | 2/2017 | Gephart et al. |
| 9,644,847 | B2 | 5/2017 | Bhogal et al. |
| 9,696,042 | B2 | 7/2017 | Hasslberger et al. |
| 9,927,129 | B2 | 3/2018 | Bhogal et al. |
| 2002/0065039 | A1 | 5/2002 | Benezech et al. |
| 2004/0031782 | A1 | 2/2004 | Westfield |
| 2004/0195399 | A1 | 10/2004 | Molla |
| 2004/0224273 | A1 | 11/2004 | Inomata |
| 2004/0224274 | A1 | 11/2004 | Tomiura |
| 2005/0112520 | A1 | 5/2005 | Todoli et al. |
| 2005/0199232 | A1 | 9/2005 | Gama et al. |
| 2005/0268794 | A1 | 12/2005 | Nesterov |
| 2007/0124972 | A1 | 6/2007 | Ratcliffe |
| 2007/0251936 | A1 | 11/2007 | Nam et al. |
| 2007/0281267 | A1 | 12/2007 | Li |
| 2008/0029081 | A1 | 2/2008 | Gagas et al. |
| 2008/0050687 | A1 | 2/2008 | Wu |
| 2008/0173632 | A1 | 7/2008 | Jang et al. |
| 2008/0210685 | A1 | 9/2008 | Beier |
| 2009/0320823 | A1 | 12/2009 | Padgett |
| 2010/0035197 | A1 | 2/2010 | Cadima |
| 2010/0126496 | A1 | 5/2010 | Luo et al. |
| 2010/0154776 | A1 | 6/2010 | Czajka et al. |
| 2010/0192939 | A1 | 8/2010 | Parks |
| 2011/0027733 | A1 | 2/2011 | Yamamoto et al. |
| 2011/0142998 | A1 | 6/2011 | Johncock et al. |
| 2011/0163086 | A1 | 7/2011 | Aldana Arjol et al. |
| 2011/0248021 | A1 | 10/2011 | Gutierrez et al. |
| 2012/0017595 | A1 | 1/2012 | Liu |
| 2012/0036855 | A1 | 2/2012 | Hull |
| 2012/0067334 | A1 | 3/2012 | Kim et al. |
| 2012/0076351 | A1 | 3/2012 | Yoon et al. |
| 2012/0099761 | A1 | 4/2012 | Yoon et al. |
| 2012/0160228 | A1 | 6/2012 | Kim et al. |
| 2012/0171343 | A1 | 7/2012 | Cadima et al. |
| 2012/0261405 | A1 | 10/2012 | Kurose et al. |
| 2013/0043239 | A1 | 2/2013 | Anton Falcon et al. |
| 2013/0252188 | A1 | 9/2013 | Chen |
| 2013/0255663 | A1 | 10/2013 | Cadima et al. |
| 2013/0260618 | A1 | 10/2013 | Bally et al. |
| 2014/0048055 | A1 | 2/2014 | Ruther |
| 2014/0090636 | A1 | 4/2014 | Bettinzoli |
| 2014/0097172 | A1 | 4/2014 | Kang et al. |
| 2014/0116416 | A1 | 5/2014 | Saubert |
| 2014/0137751 | A1 | 5/2014 | Bellm |
| 2014/0139381 | A1 | 5/2014 | Sippel |
| 2014/0318527 | A1 | 10/2014 | Silva et al. |
| 2015/0096974 | A1 | 4/2015 | Freeman et al. |
| 2015/0136760 | A1 | 5/2015 | Lima et al. |
| 2015/0153041 | A1 | 6/2015 | Neumeier |
| 2015/0241069 | A1 | 8/2015 | Brant et al. |
| 2015/0330640 | A1 | 11/2015 | Stork genannt Wersborg |
| 2015/0345800 | A1 | 12/2015 | Cabrera Botello |
| 2015/0359045 | A1 | 12/2015 | Neukamm et al. |
| 2016/0029439 | A1 | 1/2016 | Kurose et al. |
| 2016/0061490 | A1 | 3/2016 | Cho et al. |
| 2016/0095469 | A1 | 4/2016 | Gregory et al. |
| 2016/0116160 | A1 | 4/2016 | Takeuchi |
| 2016/0153666 | A1 | 6/2016 | Tcaciuc |
| 2016/0178209 | A1 | 6/2016 | Park et al. |
| 2016/0178212 | A1 | 6/2016 | Park et al. |
| 2016/0187002 | A1 | 6/2016 | Ryu et al. |
| 2016/0201902 | A1 | 7/2016 | Cadima |
| 2016/0209044 | A1 | 7/2016 | Cadima |
| 2016/0295644 | A1 | 10/2016 | Khokle et al. |
| 2016/0296067 | A1 | 10/2016 | Laws |
| 2017/0003033 | A1 | 1/2017 | Lona Santoyo et al. |
| 2017/0067651 | A1 | 3/2017 | Khokle et al. |
| 2017/0082296 | A1 | 3/2017 | Jeong et al. |
| 2017/0082299 | A1 | 3/2017 | Rowley et al. |
| 2017/0103228 | A1 | 4/2017 | Park et al. |
| 2017/0115008 | A1 | 4/2017 | Erbe et al. |
| 2017/0223774 | A1 | 8/2017 | Cheng et al. |
| 2017/0261213 | A1 | 9/2017 | Park et al. |
| 2018/0058702 | A1 | 3/2018 | Jang et al. |

FOREIGN PATENT DOCUMENTS

| | | | | |
|---|---|---|---|---|
| CN | 201680430 | | 12/2010 | |
| DE | 2845869 | A1 | 4/1980 | |
| DE | 3014908 | A1 | 10/1981 | |
| DE | 3238441 | A1 | 4/1984 | |
| DE | 3446621 | A1 | 6/1986 | |
| DE | 3839657 | A1 | 5/1990 | |
| DE | 4103664 | C1 | 1/1992 | |
| DE | 4445594 | A1 | 6/1996 | |
| DE | 60004581 | T2 | 6/2004 | |
| DE | 102004002466 | A1 | 8/2005 | |
| DE | 102005059505 | | 6/2007 | |
| DE | 102005059505 | A1 | 6/2007 | |
| DE | 102007021297 | | 11/2008 | |
| DE | 102008042467 | A1 | 4/2010 | |
| DE | 102008051829 | | 4/2010 | |
| DE | 102008051829 | A1 | 4/2010 | |
| DE | 102013218714 | A1 | 4/2014 | |
| EP | 0000908 | | 3/1979 | |
| EP | 0000908 | A1 | 3/1979 | |
| EP | 0122966 | A2 | 10/1984 | |
| EP | 0429120 | | 11/1990 | |
| EP | 0690659 | | 1/1996 | |
| EP | 1030114 | A1 | 8/2000 | |
| EP | 1217306 | A2 | 6/2002 | |
| EP | 1344986 | A1 | 9/2003 | |
| EP | 1617148 | | 1/2006 | |
| EP | 1617148 | A1 | 1/2006 | |
| EP | 1201998 | B1 | 3/2006 | |
| EP | 1460342 | B1 | 5/2006 | |
| EP | 2116775 | A1 | 11/2009 | |
| EP | 2116829 | A1 | 11/2009 | |
| EP | 2276227 | A2 | 1/2011 | |
| EP | 2299181 | A1 | 3/2011 | |
| EP | 2375170 | A1 | 10/2011 | |
| EP | 2144012 | B1 | 9/2012 | |
| EP | 2657615 | A1 | 10/2013 | |
| EP | 2816291 | A1 | 12/2014 | |
| EP | 2835580 | A2 | 2/2015 | |
| EP | 3006832 | A1 | 4/2016 | |
| FR | 2789753 | A1 | 8/2000 | |
| FR | 3003338 | A1 | 9/2014 | |
| GB | 2158225 | A | 11/1985 | |
| JP | 2010038475 | | 2/2010 | |
| JP | 2011144982 | A | 7/2011 | |
| WO | 2006136363 | | 12/2006 | |
| WO | 2012077050 | A2 | 6/2012 | |
| WO | 2013098330 | A2 | 7/2013 | |
| WO | 2013104521 | | 7/2013 | |
| WO | 2013104521 | A1 | 7/2013 | |
| WO | WO-2013104521 | A1 * | 7/2013 | ..... E24C 15/327 |
| WO | 2013182410 | A1 | 12/2013 | |
| WO | 2014194176 | A1 | 12/2014 | |
| WO | 2015086420 | A1 | 6/2015 | |

OTHER PUBLICATIONS

True-Heat burner, image post date Jan. 30, 2015, originally in U.S. Appl. No. 29/539,768 in Restriction Requirement dated Oct. 27, 2016, 2 pages, <http://ovens.reviewed.com/news/kitchenaid-has-a-new-flame>.

Metal Cover Gas Hob, image post date 2012, originally in U.S. Appl. No. 29/539,768 in Restriction Requirement dated Oct. 27,

(56) References Cited

OTHER PUBLICATIONS 2016, 13 pages, <http://inse.gmc.globalmarket.com/products/details/metal-cover-gas-hob-8516959.html>.
Penny Stove, image post date 2004, originally in U.S. Appl. No. 29/539,768 in Restriction Requirement dated Oct. 27, 2016, 30 pages, <http://www.jureystudio.com/pennystove/stoveinstruction.html>.

* cited by examiner

FORCED CONVECTION STEAM ASSEMBLY

BACKGROUND

Generally, a convection oven includes a convection fan that is near one or more heating elements. The heating element heats air which is blown into the cooking cavity of the oven by the convection fan. While the convection fan is useful to heat and/or cook an item within the cooking cavity, the heated air blown into the cooking cavity can make the item very dry. Stand-alone steam systems are very large and costly to integrate into a cooking appliance. For example, a powered boiler is large, expensive, and requires welding and additional electrical power which may require sharing power with the heating elements and/or the convection fan motor. Thus, it is desirable to have a convection oven that has a smaller, less-expensive approach to provide moisture into the cooking cavity to help keep the item in the cooking cavity moist.

SUMMARY OF THE INVENTION

One aspect of the present invention is an oven with a housing defining a cooking cavity. The oven has a door coupled to the housing. The oven has a convection fan assembly with a convection fan and at least one heating element to generate heat and to heat the air in the cooking cavity. The oven also has a trough assembly with a trough tray portion located underneath a portion of the convection fan and the convection fan heating element. The trough assembly also includes a trough supply portion shaped to receive fluid and to direct the fluid to the trough tray portion so that the fluid can be heated and turned into steam by the heating element(s) and blown into the cooking cavity by the convection fan.

Another aspect of the present invention is a convection fan assembly with a steaming device. The convection fan assembly has a convection fan connected to a motor that rotates the convection fan and at least one generally annular heating element coupled near the convection fan. The convection fan assembly also has a trough assembly. The trough assembly has a trough tray located underneath a portion of the convection fan and the generally annular heating element(s). The trough assembly also has a trough supply portion shaped to receive fluid and to direct the fluid to the trough tray portion so that the fluid can be heated by the generally annular heating element(s) and turned into steam, which is blown by the convection fan.

Another aspect of the present invention is a method for providing steam to a convection oven. The method includes forming a trough tray capable of holding fluid while surrounding a portion of the heating element(s) of the convection oven. The method includes forming a trough supply portion shaped to direct fluid to the trough tray. The method also includes adding fluid to the trough tray so that the fluid can be heated by the heating element(s) of the convection oven and forced into the oven cooking cavity by the fan of the convection oven.

These and other features, advantages, and objects of the present invention will be further understood and appreciated by those skilled in the art upon studying the following specification, claims, and appended drawings.

DETAILED DESCRIPTION OF THE PREFERRED EMBODIMENTS

Figure 1:
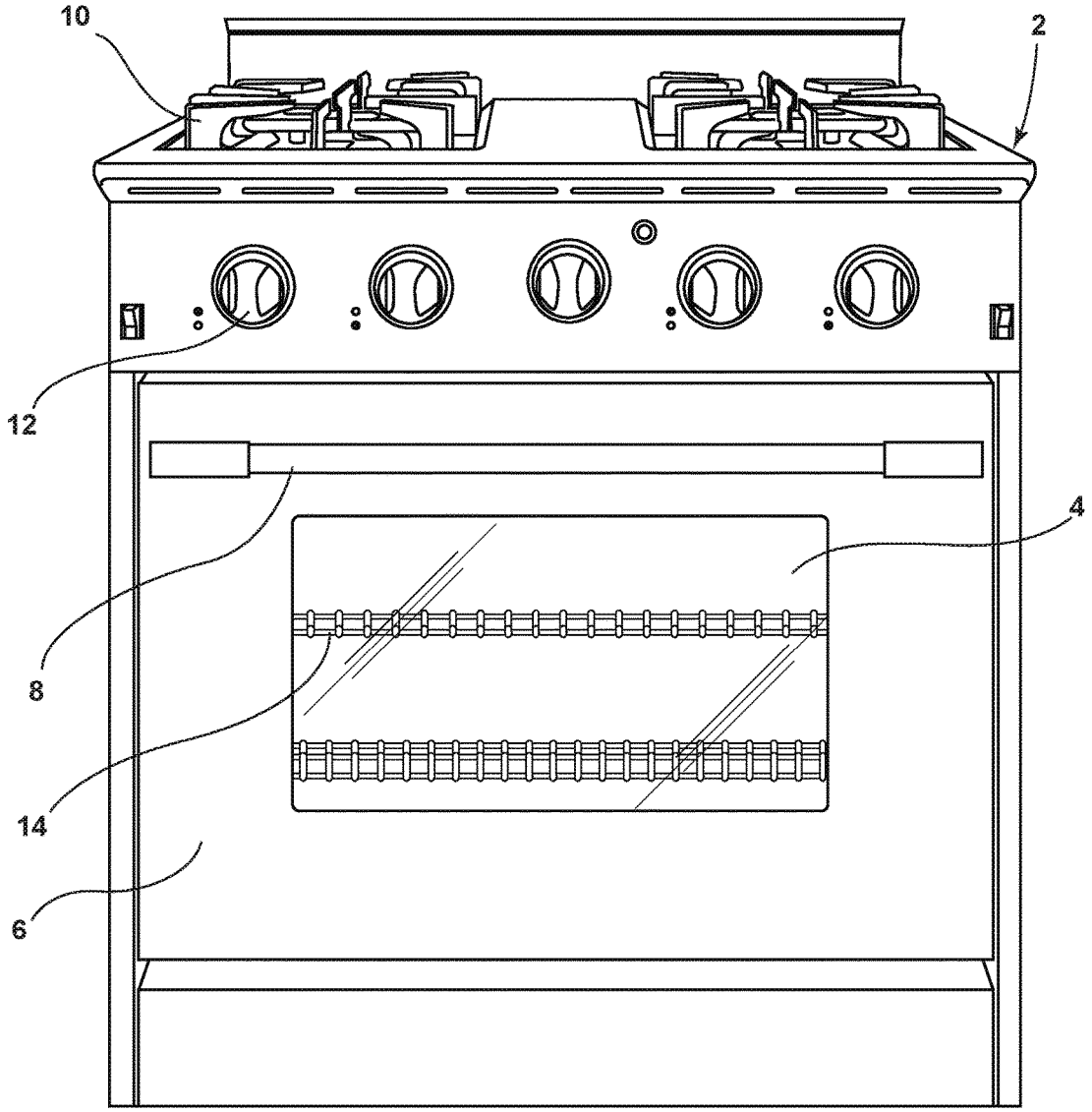
FIG. 1 is a front perspective view of an oven according to an embodiment of the present concept.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in FIG. 1. However, it is to be understood that the present disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 2:
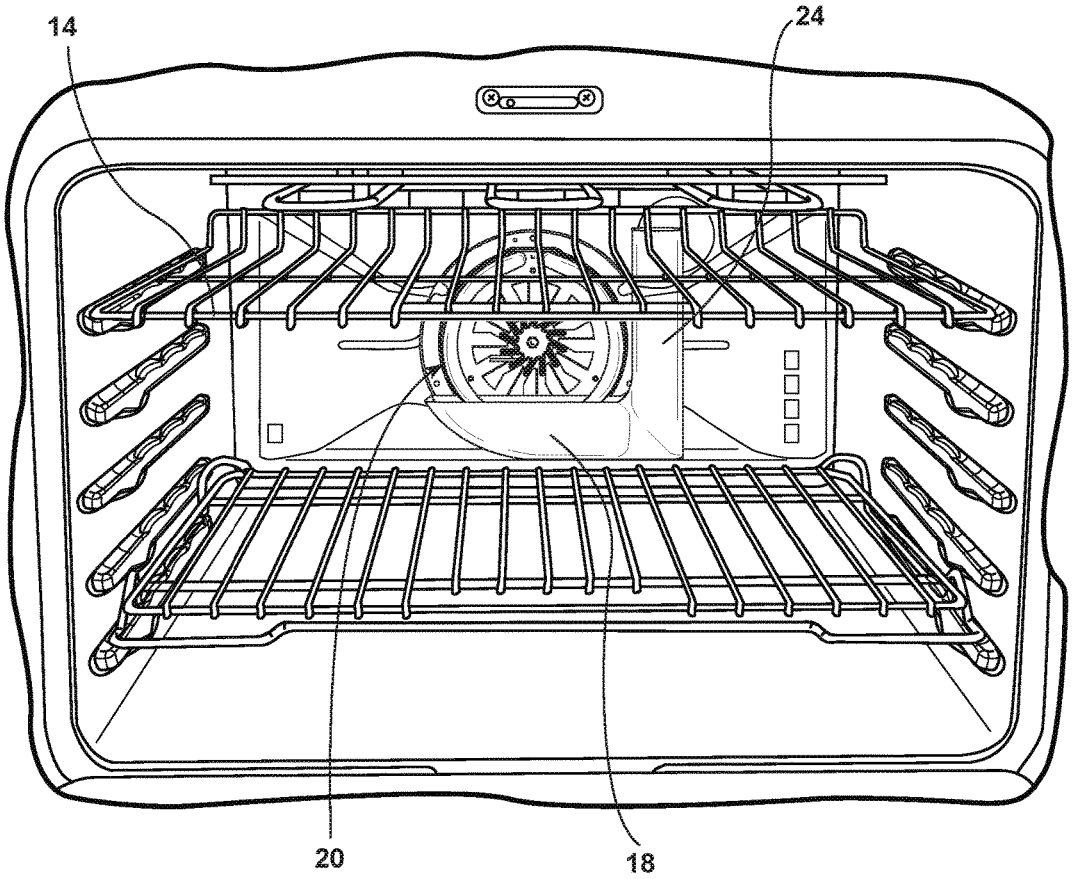
FIG. 2 is a partial front perspective view of the cavity of the oven shown in FIG. 1 with the baffle covering the convection assembly removed.
Figure 3:
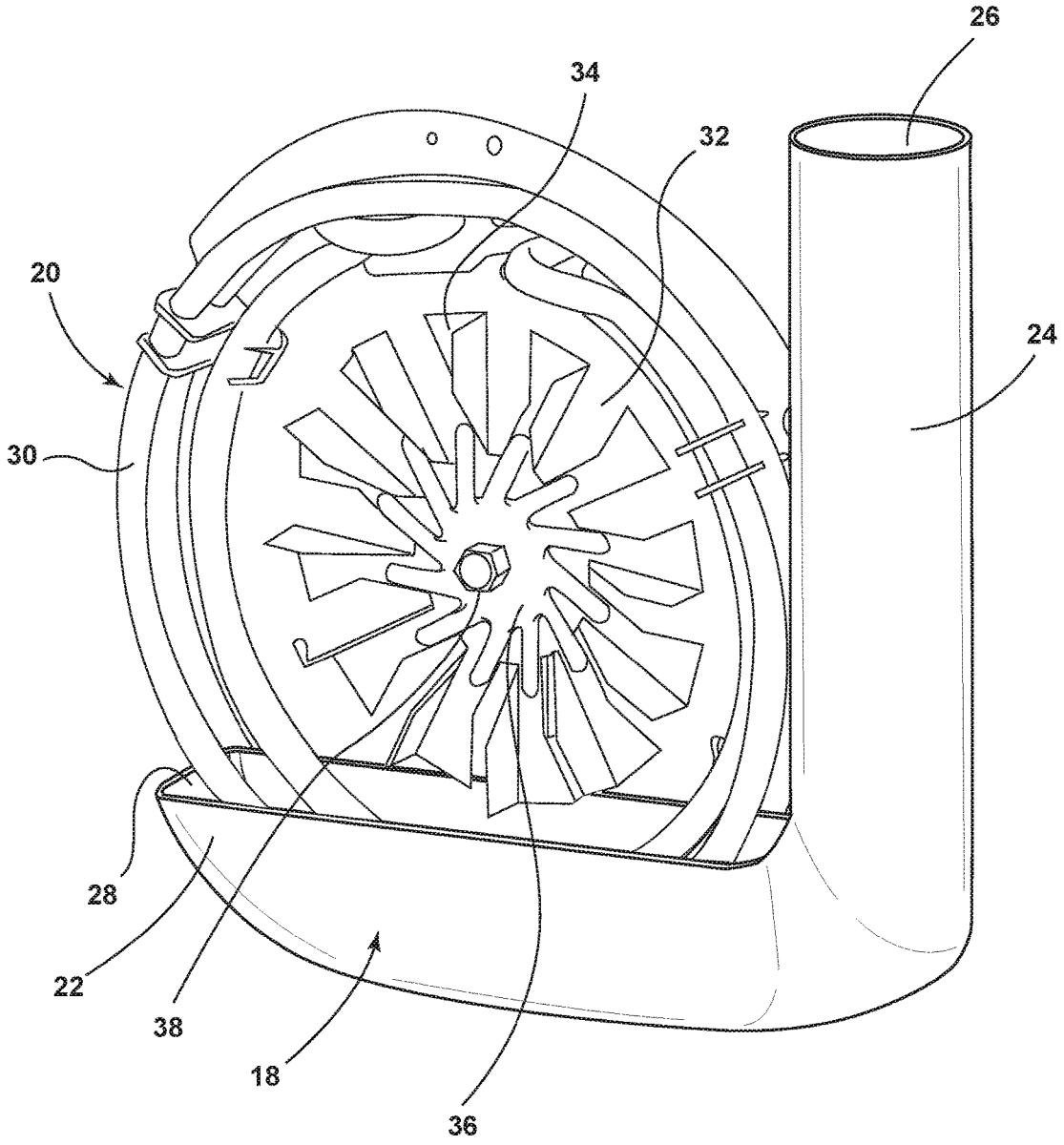
FIG. 3 is a front perspective view of the convection fan assembly and trough assembly of the oven shown in FIG. 1.
Figure 4:
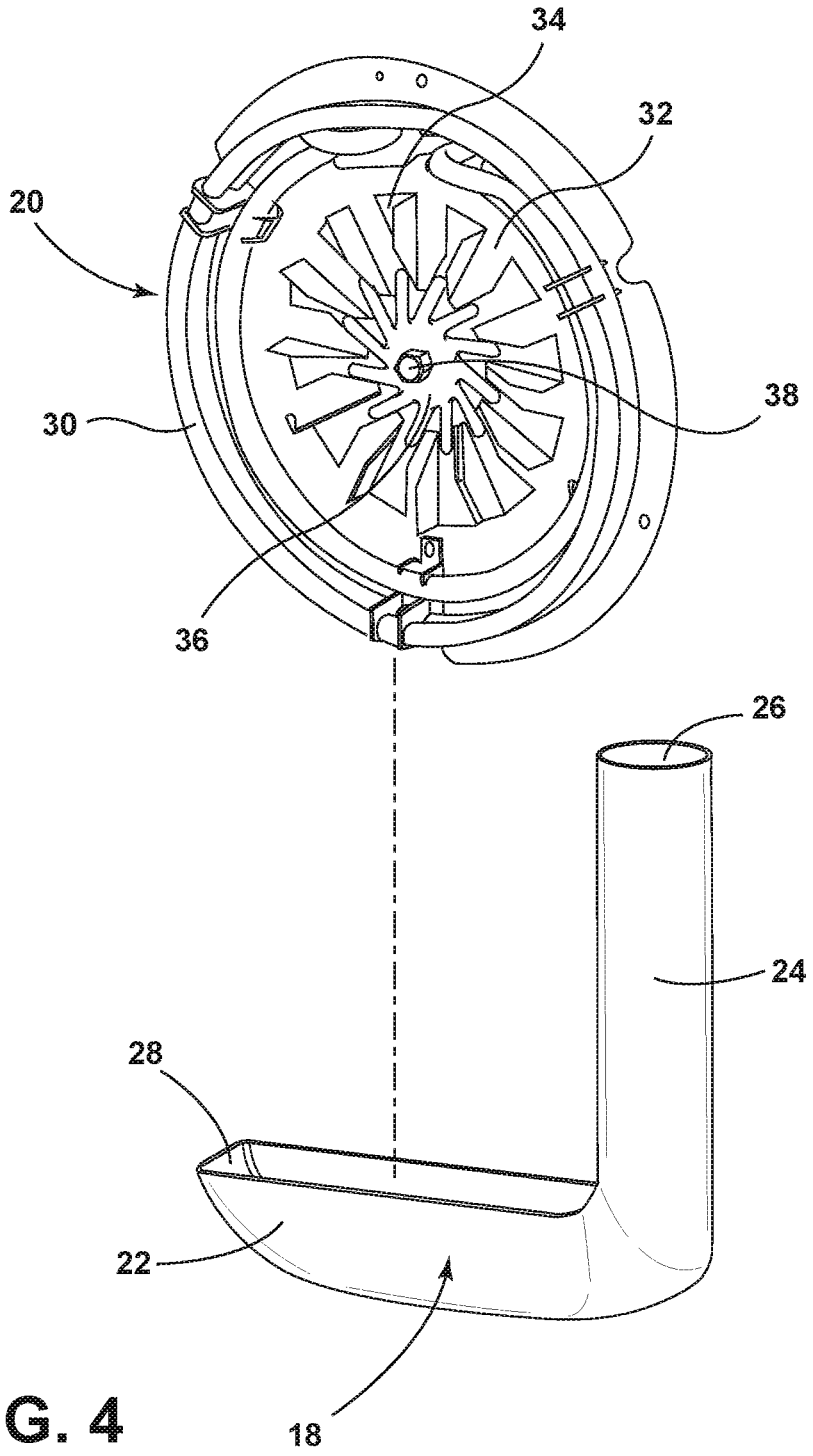
FIG. 4 is front perspective view of the convection fan assembly and trough assembly shown in FIG. 3 before the trough assembly is situated around a portion of the convection fan assembly.

With reference to the drawings, an oven 2 includes a cooking cavity 4 and an oven door 6. The oven door 6 can have a handle 8 to assist in the opening and closing of the oven door 6 for access to the cooking cavity 4. The oven 2 can have a number of burners 10 that are controlled by associated burner controls 12. As illustrated in FIG. 2, the cooking cavity 4 can have one or more racks 14 that are supported by rack supports 16.

The oven 2 includes a convection fan assembly 20 that provides heated air to the cooking cavity 4 to heat and/or cook items within the cooking cavity 4. Typically, a baffle (not shown) is placed over the convection fan assembly 20 to prevent contact with the components of the convection fan assembly 20 when the cooking cavity 4 is used. This baffle has apertures that allow air to pass from the convection fan assembly 20 to the cooking cavity 4.

The convection fan assembly 20 includes a mounting plate 32 that allows the convection fan assembly 20 to be coupled to the cooking cavity 4. The convection fan assembly 20 includes a fan blade 34 that is rotated by a motor coupled to a connection 36. A fastener 38 is used to secure the fan blade 34 to the connection 36.

Figure 6:
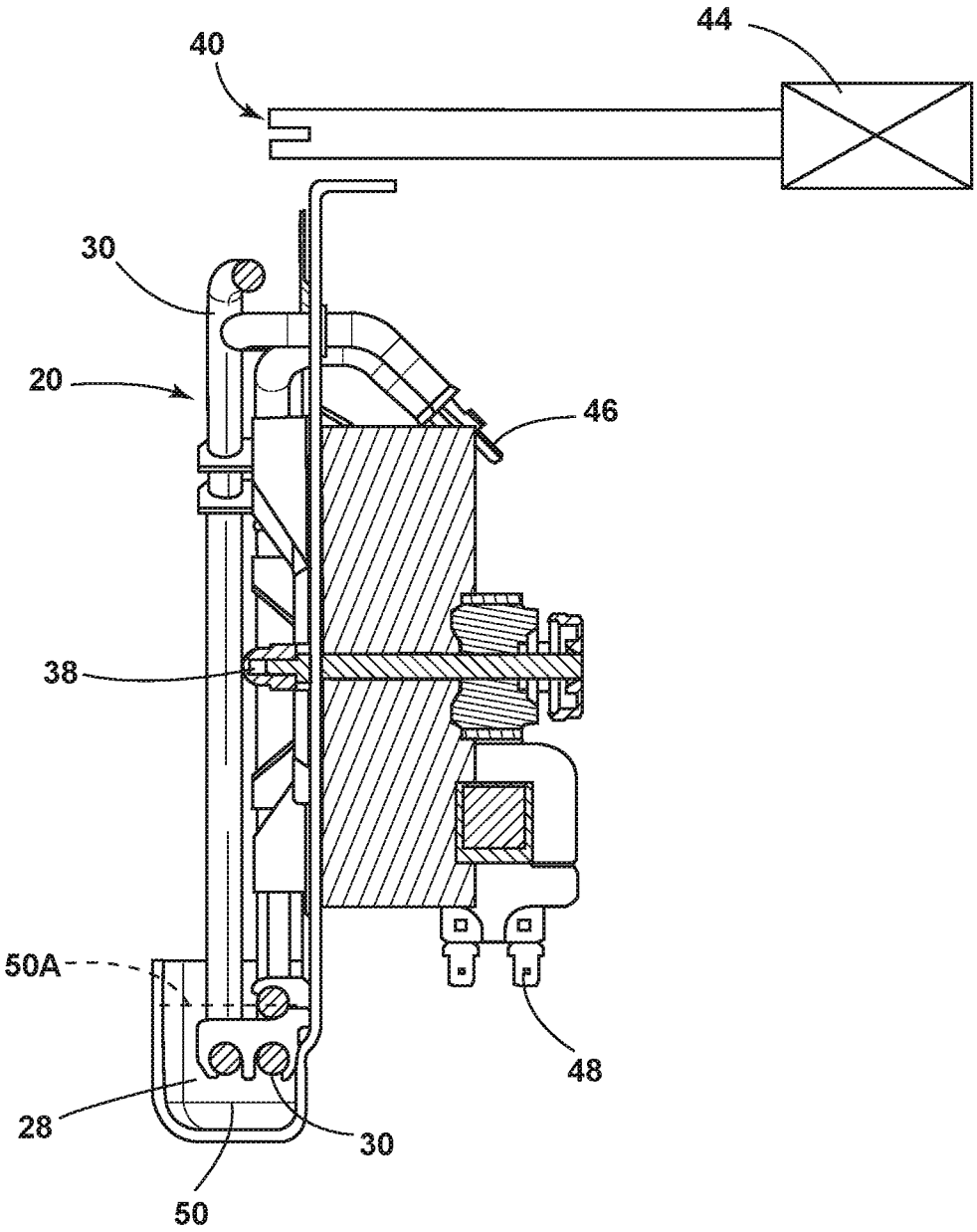
FIG. 6 is a partial cross section showing the convection fan assembly, the trough assembly, and fluid supply along with fluid level(s) in the trough assemblies.

In the illustrated embodiment, the convection fan assembly 20 has a generally annular heating element(s) 30. These heating element(s) 30 are positioned generally near the fan blade 34 but do not inhibit the movement of the fan blade 34. As illustrated in FIG. 6, the fan motor is powered by electrical connection 48, while the heating element(s) 30 are powered by electrical connection 46.

A trough assembly 18 includes a trough tray portion 22 with an interior 28 and a trough supply portion 24, as illustrated in FIGS. 2-6. While the trough tray portion 22 and trough supply portion 24 are shown as a unitary piece in the illustrated embodiment, they can be separate pieces that are positioned relative to each other.

The trough tray portion 22 is shaped to surround a portion of the convection fan assembly 20, as shown in FIGS. 2-6. When the trough tray portion 22 is situated around the convection fan assembly 20, a portion of the heating element(s) 30 is within the interior 28 of the trough tray portion 22.

The trough supply portion 24 has a generally cylindrical tubular design in the illustrated embodiment. However, the trough supply portion 24 can be of any shape, so long as it can direct fluid to the trough tray portion 22. However, in some embodiments the trough tray portion 22 can be manually filled with fluid and/or have a fluid connection directly to the trough tray portion 22 without the need for a trough supply portion 24.

The trough tray portion 22 and the trough supply portion 24 can be made of the same or different materials. The trough tray portion 22 needs to be made of a material that can withstand the heat generated by the heating element(s) 30. Thus, the trough tray portion 22 can be made of metal or a high temperature-resistant ceramic or polymeric material.

Figure 5:
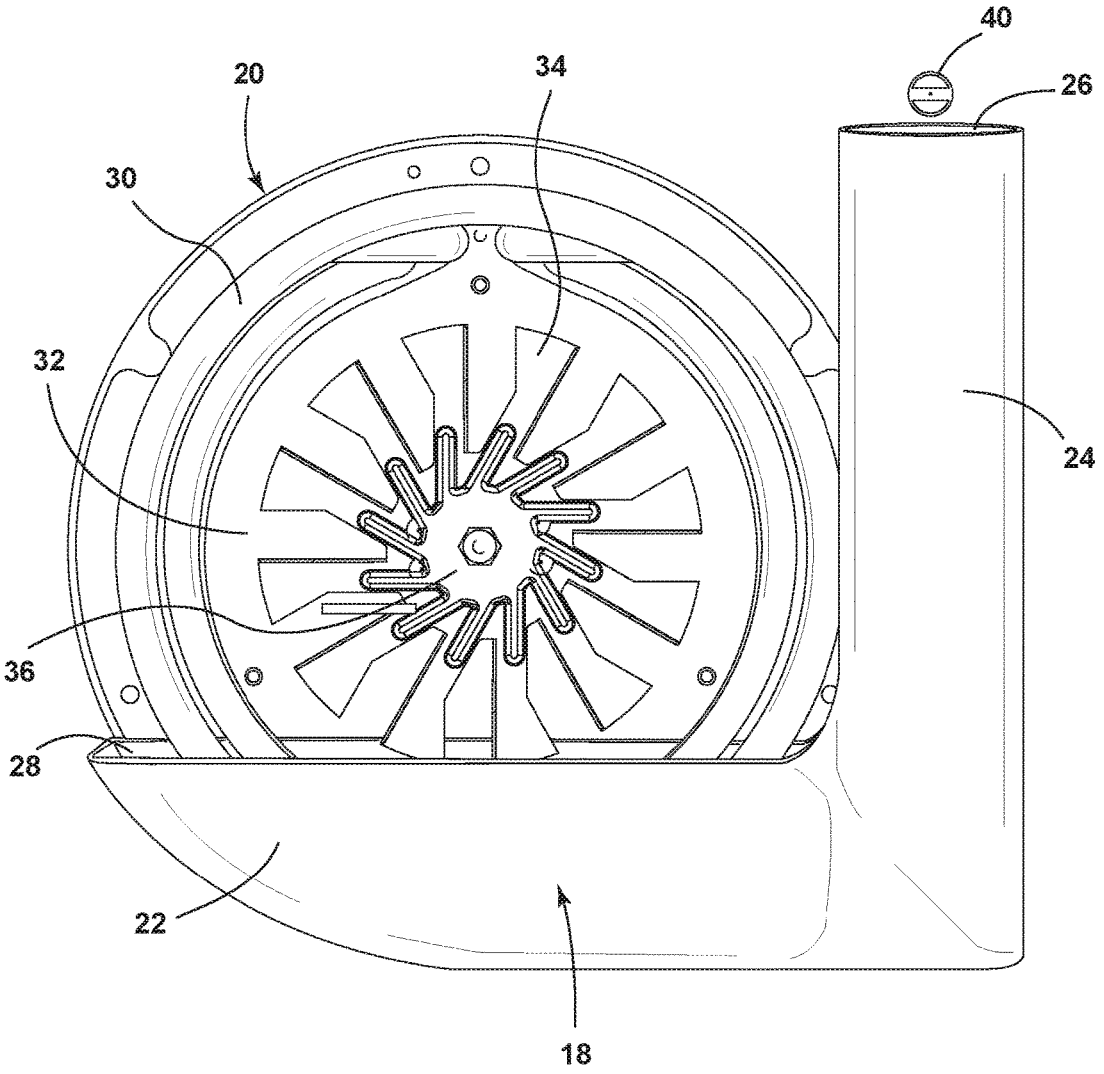
FIG. 5 is a front view of the convection fan assembly and trough assembly showing a drip valve above a portion of the trough assembly.

A fluid supply system can be used to supply fluid to the trough tray portion 22. As shown in FIGS. 5 and 6, that fluid supply system can be used in connection with the trough supply portion 24. For example, tube end 40 may be positioned over the interior opening 26 of the trough supply portion 24. The tube 42 extends from a valve 44 to the tube end 40, as illustrated in FIG. 6.

As illustrated in FIG. 6, the fluid level 50 can be below the heating element(s) 30. In this arrangement, the heating element(s) 30 can heat the fluid and turn it into steam to be forced into the cooking cavity 4 by rotation of the fan blade 34. Also as illustrated in FIG. 6, the fluid level 50A can actually cover a portion of the heating element(s) 30. Again, in this arrangement, the heating element(s) 30 will heat the fluid and turn it into steam to be forced into the cooking cavity 4 by rotation of the fan blade 34.

The fluid can be water or water with an additive. For example, the additives could include any number of different flavors, such as liquid smoke, liquid garlic, or any other desired flavor.

The valve 44 can be of any type of valve. For example, it can be a drip ball valve, a solenoid valve, or other type of valve.

The valve 44 may be controlled electronically. For example, the valve 44 can be opened or closed based upon any one or combination of factors, including, but not limited to, the humidity in the cooking cavity 4, the fluid level 50, 50A in the trough tray portion 22, timing, steam percent, etc.

The fluid supply can also include a conduction break to prevent heat transfer to the valve 44. In addition, the fluid supply can have multiple outlets for multiple convection fans.

The heating element(s) 30 can be any type of heating element(s). In the illustrated embodiment, the heating element(s) 30 in a calrod burner that can reach a temperature of approximately 700° C. (1292° F.) which will turn the fluid into steam.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed:

1. An oven comprising:

an oven housing defining a cooking cavity;

a door coupled to the housing;

a convection fan assembly comprising a convection fan with a fan blade and at least one generally cylindrical heating element surrounding said blade to heat up the air in the cooking cavity;

a trough assembly comprising an open trough tray portion having walls surrounding a portion of said at least one generally cylindrical heating element, and a trough supply portion shaped to receive fluid and direct it to the trough tray portion so that it can be heated and turned into steam by said at least one generally cylindrical heating element and blown into said cooking cavity by said convection fan.

2. The oven of claim 1, wherein:

said trough assembly is manually filled with fluid.

3. The oven of claim 1, wherein:

said trough tray portion and said trough supply portion are connected.

4. The oven of claim 1, wherein:

said trough assembly is filled with fluid by a drip ball valve positioned above said trough supply portion of said trough assembly.

5. The oven of claim 4, wherein:

said drip ball valve is controlled electronically.

6. The oven of claim 1, wherein:

said trough assembly is filled with fluid by a fluid line connected to a solenoid valve.

7. The oven of claim 1, wherein:

said fluid is water with an additive.

8. The oven of claim 1, including:

a fluid delivery system that has a conduction break to prevent heat from travelling to at least one valve in said fluid delivery system.

* * * * *